US005387923A

United States Patent [19]

Mattison et al.

[11] Patent Number: 5,387,923

[45] Date of Patent: Feb. 7, 1995

[54] VGA CONTROLLER USING ADDRESS TRANSLATION TO DRIVE A DUAL SCAN LCD PANEL AND METHOD THEREFOR

[75] Inventors: Phillip E. Mattison, Gilbert; Kenneth P. Caviasca, Phoenix, both of Ariz.

[73] Assignee: VLSI Technology, Inc., San Jose, Calif.

[21] Appl. No.: 147,092

[22] Filed: Nov. 3, 1993

Related U.S. Application Data

[63] Continuation of Ser. No. 855,983, Mar. 20, 1992, abandoned.

[51] Int. Cl.[6] ..... G09G 3/36

[52] U.S. Cl. ..... 345/103; 345/98

[58] Field of Search ..... 345/103, 87, 98, 99, 345/100; 358/241, 236; 359/54, 55; 348/790, 792, 793

[56] References Cited

U.S. PATENT DOCUMENTS

| | | | |
|---|---|---|---|
| 4,630,122 | 12/1986 | Morokawa | 358/241 |
| 4,679,043 | 7/1987 | Morokawa | 340/805 |
| 4,745,485 | 5/1988 | Iwasaki | 340/784 |
| 4,816,816 | 3/1989 | Usui | 340/784 |
| 4,824,212 | 4/1989 | Taniguchi | 340/765 |
| 4,845,473 | 7/1989 | Matsuhashi et al. | 340/805 |
| 4,875,036 | 10/1989 | Washizuka et al. | 340/805 |
| 4,985,698 | 1/1991 | Mano et al. | 340/784 |
| 5,148,155 | 9/1992 | Martin et al. | 178/18 |

*Primary Examiner*—Ulysses Weldon
*Assistant Examiner*—Xiao M. Wu
*Attorney, Agent, or Firm*—Harry M. Weiss

[57] ABSTRACT

A VGA controller using address translation logic to drive a dual scan LCD panel is disclosed. The address translation logic converts the display data into an interleaved format in the display buffer, allowing the VGA controller to simultaneously access the display data for both LCD inputs without the need for a separate half-frame buffer memory. Elimination of this half-frame buffer memory reduces system cost with no reduction in performance of the VGA controller.

3 Claims, 1 Drawing Sheet

VGA CONTROLLER USING ADDRESS TRANSLATION TO DRIVE A DUAL SCAN LCD PANEL AND METHOD THEREFOR

This is a continuation of co-pending application Ser. No. 07/855,983 filed on Mar. 20, 1992, now abandoned.

FIELD OF THE INVENTION

This invention generally relates to computer display devices and methods therefor, and, more specifically, relates to a Video Graphics Adapter (VGA) controller that uses an address translation scheme to drive a dual scan Liquid Crystal Display (LCD) panel and method therefor.

DESCRIPTION OF THE PRIOR ART

When driving a dual scan LCD panel, the prior art VGA controller used a Display Buffer that was separated into an Upper Half-Frame and a Lower Half-Frame, with the Display Buffer occupying a linear address space of the Central Processing Unit (CPU). Due to timing constraints, the VGA Controller must access the data for both LCD inputs simultaneously. Since the address of the Upper Half-Frame and Lower Half Frame were different given their contiguous placement in memory, a method was devised to allow the VGA Controller to access the display data in the Lower Half Frame at the same time it addressed the Upper Half Frame. This method of accessing the data for both LCD inputs at the same time was accomplished by loading the display data in the Lower Half-Frame into a Half-Frame Buffer Memory which is accessed by the VGA Controller at the same time it accessed the Upper Half-Frame of the Display Buffer. The VGA Controller then loaded display data from the Upper Half-Frame into the first input to tile LCD panel, and simultaneously from the the Half-Frame Buffer Memory into the second input to the LCD panel, thereby driving both inputs of the LCD panel simultaneously. This Half-Frame Buffer Memory is expensive and adds unnecessary cost to the VGA Controller.

Therefore, there existed a need to provide a VGA Controller having address translation logic that allows the VGA Controller to drive both inputs of the LCD panel simultaneously without the need for the Half-Frame Buffer Memory.

SUMMARY OF THE INVENTION

It is an object of this invention to provide an improved VGA controller and method having address translation logic allowing the VGA controller to drive a dual scan LCD panel directly, without the need for a dedicated half-frame buffer memory.

According to the present invention, a VGA Controller with Address Translation Logic is provided. Also provided is a Display Buffer separated into two parts, the Upper Half-Frame Buffer and the Lower Half-Frame Buffer. The Address Translation Logic translates the linear CPU address space into a non-linear address space. In essence, the Upper Half-Frame Buffer and the Lower Half-Frame Buffer are interleaved one-to-one in the Display Buffer rather than each occupying a separate and contiguous address space. The Address Translation Logic performs the interleaving of display data when the CPU stores the display data in the Display Buffer. With the data stored in interleaved form, the VGA controller can perform one access to retrieve the display information needed for both inputs to the LCD panel. Since the VGA Controller drives both inputs of the LCD panel directly from the Display Buffer, there is no need for the Half-Frame Buffer Memory used on prior art VGA controllers. The Address Translation Logic automatically performs the interleaving of display data in the Display Buffer, so the translation is transparent to the operation of the CPU, so the CPU still writes to two contiguous blocks of memory as is done in the VGA Controller of the prior art. In like manner, when the CPU reads display data from two contiguous blocks of memory, the Address Translation Logic retrieves the interleaved data in the Display Buffer, making the Address Translation Logic completely transparent to the CPU. This allows the VGA Controller of the present invention to operate with the same hardware and software interfaces that exist for the VGA Controller of the prior art.

The foregoing and other objects, features and advantages will be apparent from the following description of tile preferred embodiment of the invention as illustrated in the accompanying drawings.

DESCRIPTION OF THE PREFERRED EMBODIMENT

Figure 1:
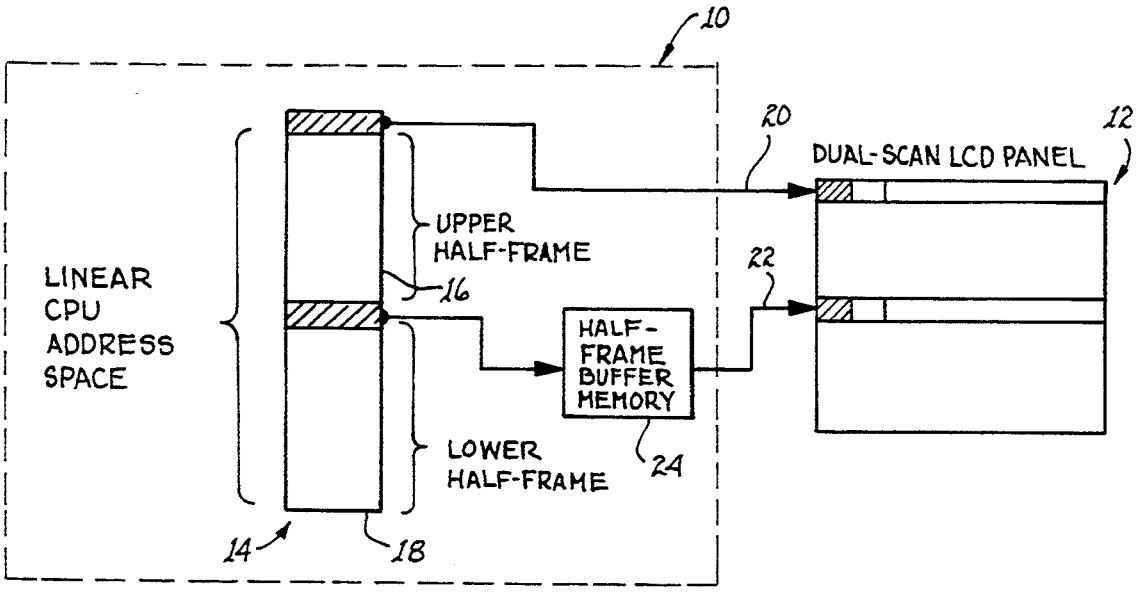
fig. 1 PRIOR ART
FIG. 1 is a block diagram of tile VGA Controller of the prior art when used to drive a dual scan LCD panel.

The function of the VGA Controller of the present invention can be best understood when compared to the VGA Controller 10 of the prior art as shown in FIG. 1 when configured to drive a dual-scan LCD panel 12. The VGA Controller 10 has a block of memory known as the Display Buffer 14 separated into an Upper Half-Frame 16 and a Lower Half-Frame 18. The Display Buffer 14 occupies a linear address space of the CPU as shown, making the two half-frames 16 and 18 contiguous blocks of memory.

Due to timing considerations, the VGA Controller 10 must output the display data for both inputs 20 and 22 of LCD panel 12 simultaneously. This is accomplished by transferring the contents of the Lower Half-Frame 18 into a Half-Frame Buffer Memory 24 as shown. The VGA Controller 10 has address decode logic (not shown) so that when the Upper Half-Frame 16 of the Display Buffer 14 is accessed, the data in the Half-Frame Buffer Memory 24 is also accessed. In this manner the VGA Controller 10 outputs the display data for both inputs 20 and 22 of the LCD panel 12 simultaneously. The VGA Controller 10 then increments its address to access the next portion of display data required in the Upper Half Frame 16, and continues until the entire contents of Upper Half-Frame 16 have been accessed, which outputs to LCD panel 12 the stored display data for both inputs 20 and 22 to LCD panel 12. The data in the Display Buffer 14 is repeatedly outputed to the LCD panel 12 to keep the LCD panel 12 refreshed at an appropriate rate.

Figure 2:
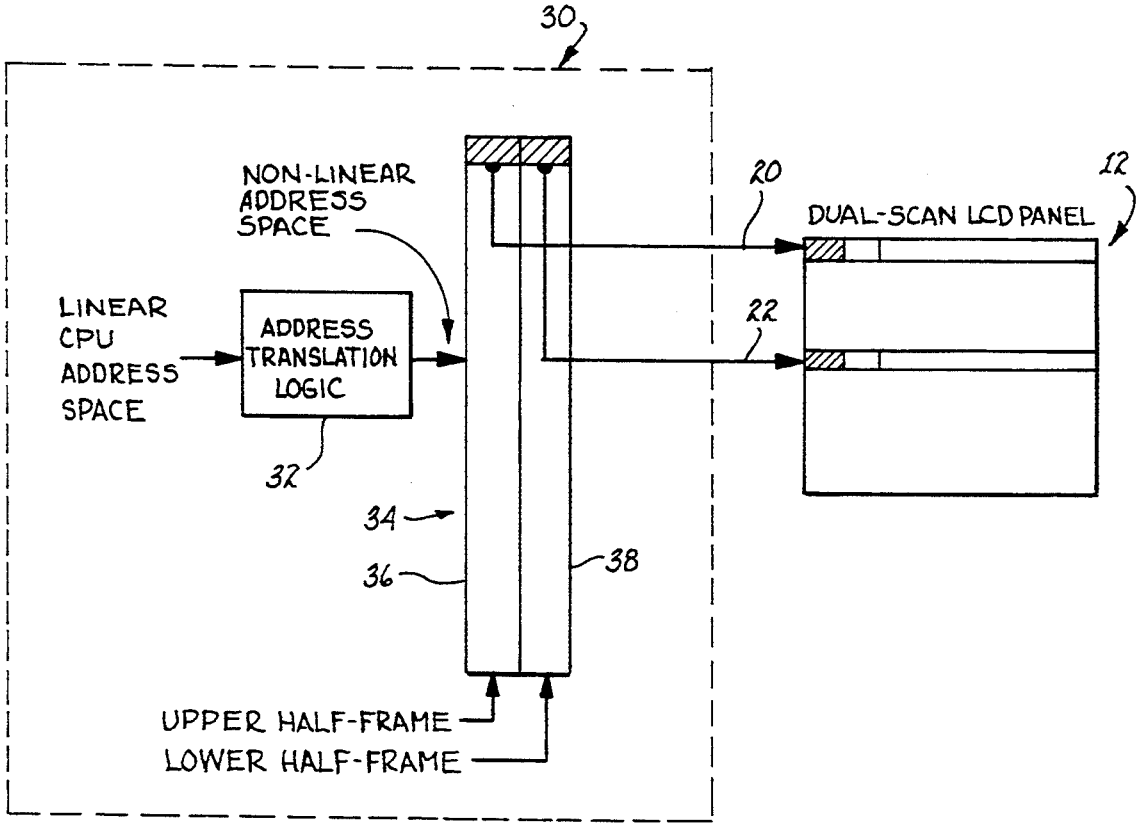
FIG. 2 is a block diagram of the VGA Controller of the present invention when used to drive a dual scan LCD panel.

Referring to FIG. 2, the VGA Controller 30 of the present invention uses a different scheme for putting out data to both inputs 20 and 22 of LCD panel 12. This VGA Controller 30 has Address Translation Logic 32 between the CPU and the Display Buffer 34. The Display Buffer 34 is comprised of an Upper Half-Frame 36 and a Lower Half-Frame 38 as shown. These half-frames 36 and 38 do not occupy two blocks of contiguous memory as in the VGA Controller 10 of the prior art. These half-frames 36 and 38 are interleaved such that every other memory location is in one half-frame, with the remaining memory locations being in the other half-frame. For example, Upper Half-Frame 36 could consist of all even memory addresses in Display Buffer 34, while Lower Half-Frame 38 would consist of all odd memory addresses in Display Buffer 34. In this manner, the VGA Controller 30 can access both half-frames simultaneously, and output the display data to the two inputs 20 and 22 of the LCD panel 12 at the same time. Since the Address Translation Logic 32 operates on both read and write operations of the CPU, the interleaving of the data in the Display Buffer 34 is completely transparent to the CPU, allowing the VGA Controller 30 of the present invention to be used with the hardware and software interfaces that are currently used with the VGA Controller 10 of the prior art.

In the present invention, the Address Translation Logic 32 replaces the Half-Frame Buffer Memory 24 of the prior art. Since the Address Translation Logic 32 comprises common and inexpensive digital logic devices, and the Half-Frame Buffer Memory 24 of the prior art uses expensive high-speed Random Access Memory (RAM), the cost of the VGA Controller 30 of the present invention is much less than the cost of the VGA Controller 10 of the prior art.

While the invention has been described in its preferred embodiment, it is to be understood that the words which have been used are words of description rather than limitation, and that changes may be made within the purview of the appended claims without departing from the true scope and spirit of the invention in its broader aspects.

I claim:

1. A VGA controller device for driving a dual scan LCD panel comprising, in combination:

Central Processing Unit (CPU) interface means having a linear address space for storing display data in said controller device;

a display buffer wherein said display data is stored within said controller device, said display buffer comprising, in combination:

separate upper half-frame buffer means for the exclusive storing of the display data for the first half of said LCD panel;

separate lower half-frame buffer means for the exclusive storing of the display data for the second half of said LCD panel; and said separate upper half-frame buffer means and said separate lower half-frame buffer means having an interleaved one-to-one configuration such that every other address of said display buffer comprises said separate upper half-frame buffer means while said remaining addresses comprises said separate lower half-frame buffer means;

address translation logic means for translating said linear address space of said CPU interface means such that said display data written through said CPU interface means in two contiguous blocks of addresses is stored in said separate upper half-frame buffer means and in said separate lower half-frame buffer means of said display buffer in said interleaved one-to-one configuration;

first and second output means for providing a first direct connection between said upper half-frame buffer means and said LCD panel and a second direct connection between said lower half-frame buffer means and said LCD panel and for driving said LCD panel; and output control means for accessing said display data stored in said display buffer such that said display data in said separate upper half-frame buffer means and said display data in said separate lower half-frame buffer means are simultaneously outputed to said first and second output means for simultaneously and directly driving said first half and said second half of said LCD panel.

2. A method for driving a dual scan LCD panel with a VGA controller device comprising the steps of:

providing Central Processing Unit (CPU) interface means having a linear address space for storing display data in said controller device;

providing a display buffer wherein said display data is stored within said controller device, said display buffer comprising, in combination:

separate upper half-frame buffer means for the exclusive storing of the display data for the first half of said LCD panel;

separate lower half-frame buffer means for the exclusive storing of the display data for the second half of said LCD panel is stored; and said separate upper half-frame buffer means and said separate lower half-frame buffer means having an interleaved one-to-one configuration such that every other address of said display buffer comprises said separate upper half-frame buffer means while said remaining addresses comprises said separate lower half-frame buffer means;

providing address translation logic means for translating said linear address space of said CPU interface means such that said display data written through said CPU interface means in two contiguous blocks of addresses is stored in said separate upper half-frame buffer means and in said separate lower half-frame buffer means of said display buffer in said interleaved one-to-one configuration;

providing first and second output means for providing a first direct connection between said upper half-frame buffer means and said LCD panel and a second direct connection between said lower half-frame buffer means and said LCD panel and for driving said LCD panel; and providing output control means for accessing said display data stored in said display buffer such that said display data in said separate upper half-frame buffer means and said display data in said separate lower half-frame buffer means are simultaneously outputed to said first and second output means for simultaneously and directly driving said first half and said second half of said LCD panel.

3. The method of claim 2 further including the steps of:

writing said display data through said CPU interface means into said display buffer;

retrieving said display data in said display buffer with said output control means, and outputting said display data to said first and second output means for driving said LCD panel.

* * * * *